US007056101B1

(12) United States Patent
Hauser et al.

(10) Patent No.: US 7,056,101 B1
(45) Date of Patent: Jun. 6, 2006

(54) INLINE TANDEM PUMP

(75) Inventors: Raymond Hauser, Sullivan, IL (US); Lonnie E. Holder, Sullivan, IL (US)

(73) Assignee: Hydro-Gear Limited Partnership, Sullivan, IL (US)

( * ) Notice: Subject to any disclaimer, the term of this patent is extended or adjusted under 35 U.S.C. 154(b) by 36 days.

(21) Appl. No.: 10/767,315

(22) Filed: Jan. 28, 2004

Related U.S. Application Data

(63) Continuation-in-part of application No. 10/175,206, filed on Jun. 19, 2002, now Pat. No. 6,705,840.

(51) Int. Cl.
*F04B 1/12* (2006.01)
*F16D 31/02* (2006.01)

(52) U.S. Cl. ..... 417/269; 60/484; 60/485; 91/504

(58) Field of Classification Search ..... 417/269; 91/499, 502, 504, 505; 60/462, 485, 484, 60/487

See application file for complete search history.

(56) References Cited

U.S. PATENT DOCUMENTS 2,875,701 A 3/1959 Ebert
2,914,219 A * 11/1959 Chiantelassa ..... 222/134
4,252,508 A 2/1981 Forster
4,270,408 A 6/1981 Wagner
4,819,508 A 4/1989 Yamaoka et al.
4,971,535 A 11/1990 Okada et al.
5,040,429 A 8/1991 Del Castillo
5,078,222 A 1/1992 Hauser et al.
5,207,060 A 5/1993 Sheets
5,304,043 A 4/1994 Shilling
5,501,578 A 3/1996 Skirde
5,800,134 A 9/1998 Hasegawa et al.
6,332,393 B1 12/2001 Trimble
6,361,282 B1 3/2002 Wanschura
6,487,856 B1 12/2002 Ohashi et al.

* cited by examiner

*Primary Examiner*—Charles G. Freay
(74) *Attorney, Agent, or Firm*—Neal, Gerber & Eisenberg LLP

(57) ABSTRACT

A dual tandem pump apparatus having a pair of coaxially arranged pump shafts and a separate input shaft that is not coaxial with the pump shafts. The trunnion arms for the two pumps may be mounted in different locations to increase application flexibility. Charge pumps may be mounted on end caps secured to the housing or may be driven directly by the input shaft. A coupler or bevel gear arrangement is used inside the pump housing to drive the pump shafts from the input shaft.

16 Claims, 16 Drawing Sheets

INLINE TANDEM PUMP

CROSS-REFERENCE

This application is a continuation-in-part of U.S. patent application Ser. No. 10/175,206, now U.S. Pat. No. 6,705,840 filed Jun. 19, 2002. This patent is incorporated herein by reference in its entirety.

BACKGROUND OF THE INVENTION

This invention relates to hydraulic pumps.

SUMMARY OF THE INVENTION

A dual tandem pump having an input shaft that is separate from the pump input shafts is disclosed herein. The details of this invention are set forth below in connection with the detailed description of the embodiments.

DETAILED DESCRIPTION OF THE DRAWINGS

Figure 1:
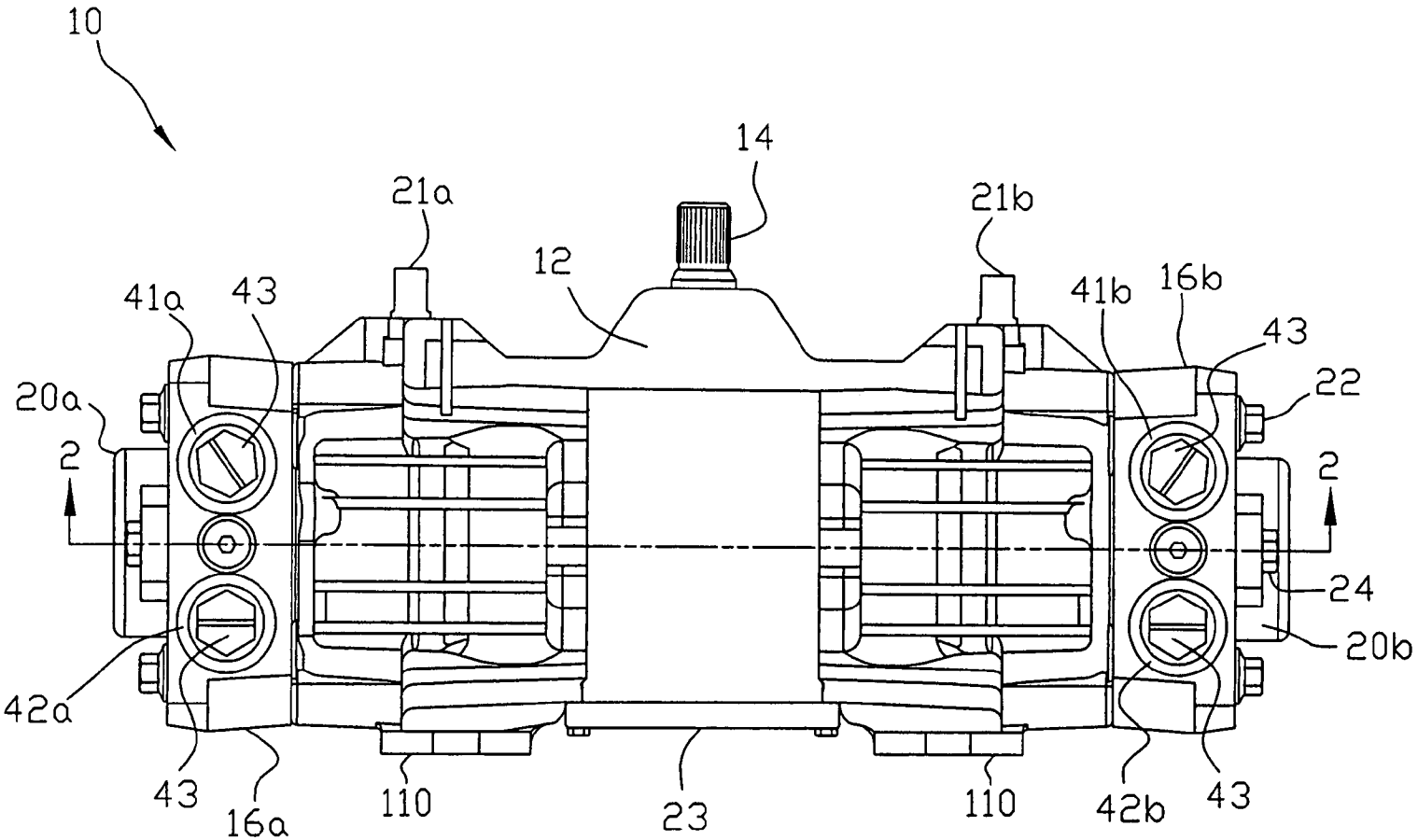
FIG. 1 is an external side view of a tandem pump in accordance with one embodiment of this invention.

One embodiment of this invention is shown in FIGS. 1, 2, 3 and 4, which depict a pump apparatus 10 having a unitary housing 12. In the embodiment described below, two generally identical pumps 11*a* and 11*b* are disclosed within unitary housing 12, and identical numerals with the letters a and b are used to reference identical parts. It will be understood by one of skill in the art that the two pumps 11*a* and 11*b* need not be identical and that substantial variations are possible to one or the other within the scope of this invention. Pumps 11*a* and 11*b* are shown as the rotating axial piston type, although other designs could be used with minor modifications within the scope of this invention. For convenience, only certain elements of pump 11*a* and its related structure are described in detail herein. It will be understood that the corresponding structure of pump 11*b* is identical in the embodiments depicted and need not be similarly described.

Housing 12 forms two generally identical pump chambers or cavities 29*a* and 29*b* and a gear chamber or cavity 30 formed therebetween, thus providing an integral housing for the two pumps 11*a* and 11*b*. A pair of end caps 16*a* and 16*b* are mounted on opposite ends of housing 12 and act to seal pump chambers 29*a* and 29*b*, and may be secured thereto by screws 22 or another means. A cover 23 is secured to the bottom of housing 12 to close gear chamber 30.

Figure 2:
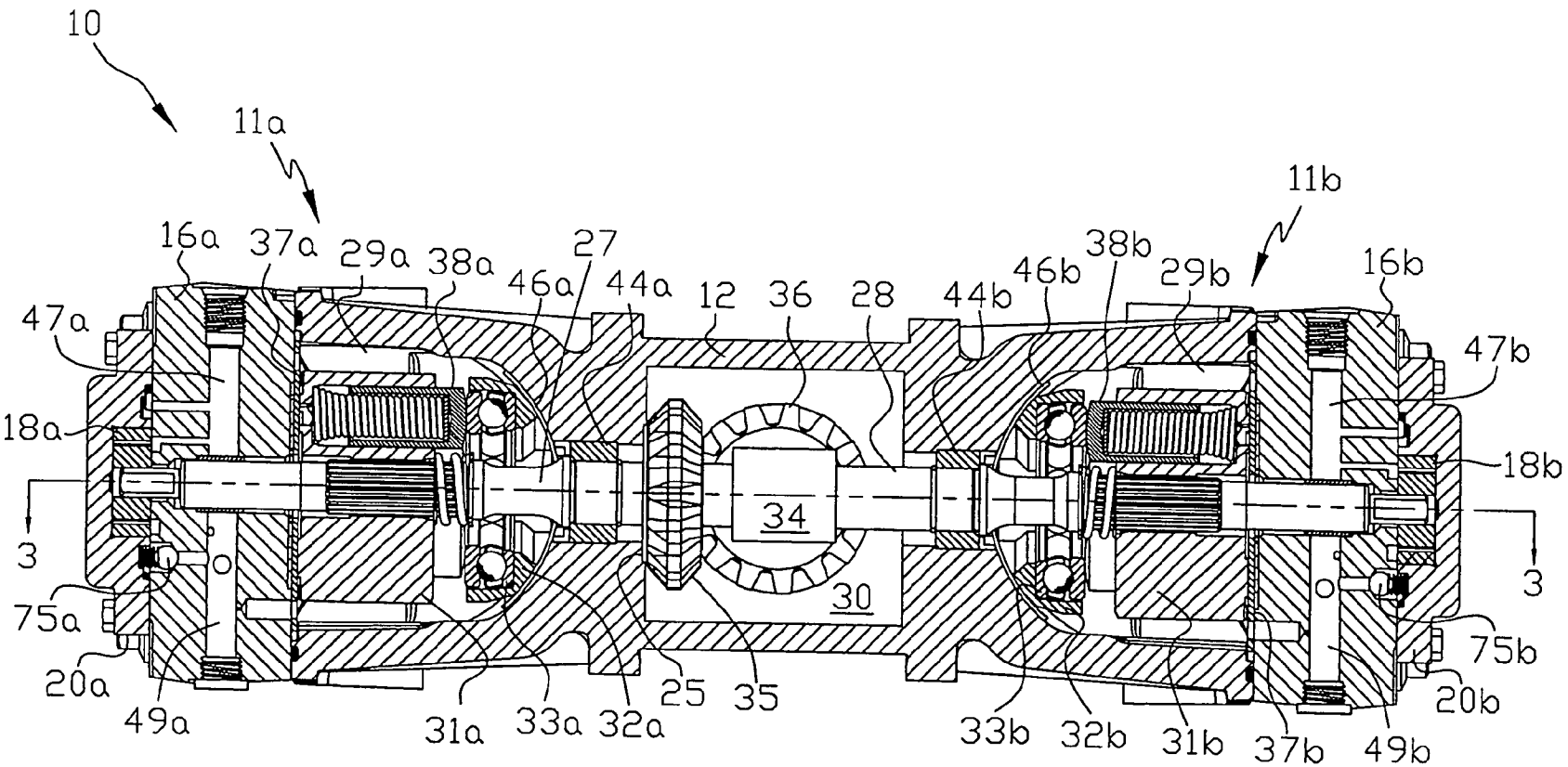
FIG. 2 is a cross-sectional view along the lines 2—2 in FIG. 1.
Figure 3:
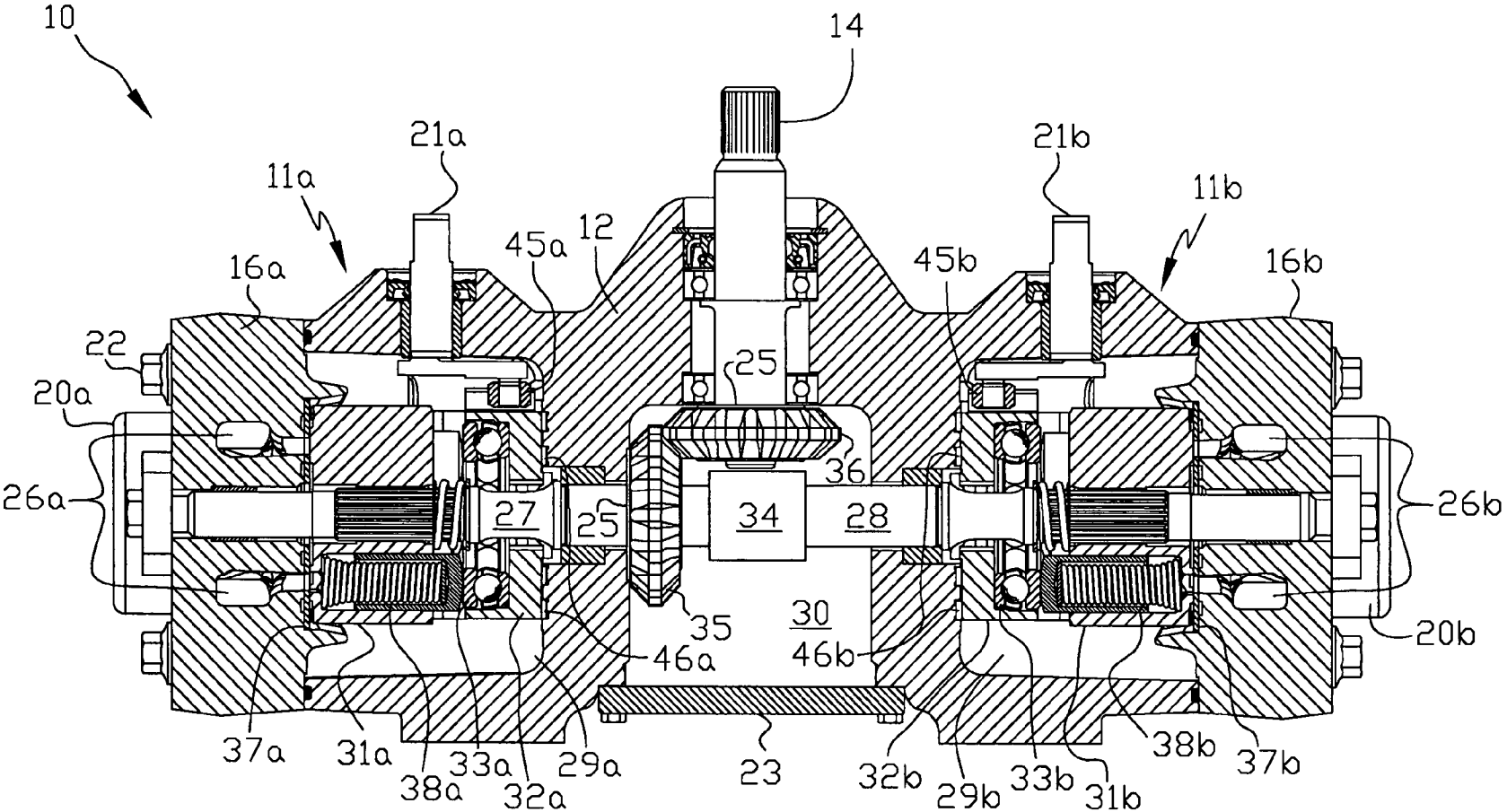
FIG. 3 is a cross-sectional side view along the lines 3—3 in FIG. 2.

With regard to pump 11*a* on the left hand side of FIGS. 1, 2 and 3, it can be seen that a pump cylinder block 31*a* comprising a plurality of axial pistons 38*a* is mounted on running plate 37*a*, which may be used for additional strength and durability. Cylinder block 31*a* could also run directly on a surface formed on end cap 16*a*. The porting in end caps 16*a* and 16*b* can be of the design shown in e.g., U.S. Pat. No. 6,332,393, the terms of which are incorporated by reference.

End cap 16*a* includes hydraulic porting 26*a* for the hydraulic fluid. System ports 41*a* and 42*a* are formed on the external surface thereof. In the view shown in FIG. 1, plugs 43 are used to seal system ports 41*a*, 41*b*, 42*a* and 42*b* for shipping; in use the system ports would be connected to hoses or the like. As shown in the schematic depicted in FIG. 4, ports 41*a* and 42*a* are connected to motor 40*a* while ports 41*b* and 42*b* are connected to motor 40*b*. Motors 40*a* and 40*b* could be wheel motors in a typical zero turn vehicle design; they could also be replaced with other hydraulic devices in other applications. A bypass 66*a* and 66*b* is provided for each pump 11*a* and 11*b* to permit, e.g., movement of the vehicle when it is not under power.

Pump 11*a* is of the cradle mounted swash plate design; as shown in FIG. 3, swash plate 32*a* is mounted in pump chamber 29*a* on cradle bearings 46*a* mounted on the inner wall of housing 12. Pistons 38*a* run against swash bearing 33*a* mounted in swash plate 32*a*. Trunnion arm 21*a* is engaged to a control block 45*a* that is engaged to swash plate 32*a*, so that rotation of trunnion arm 21*a* causes movement of swash plate 32*a* to the various stroked forward or reverse positions, or to the neutral position.

Figure 4:
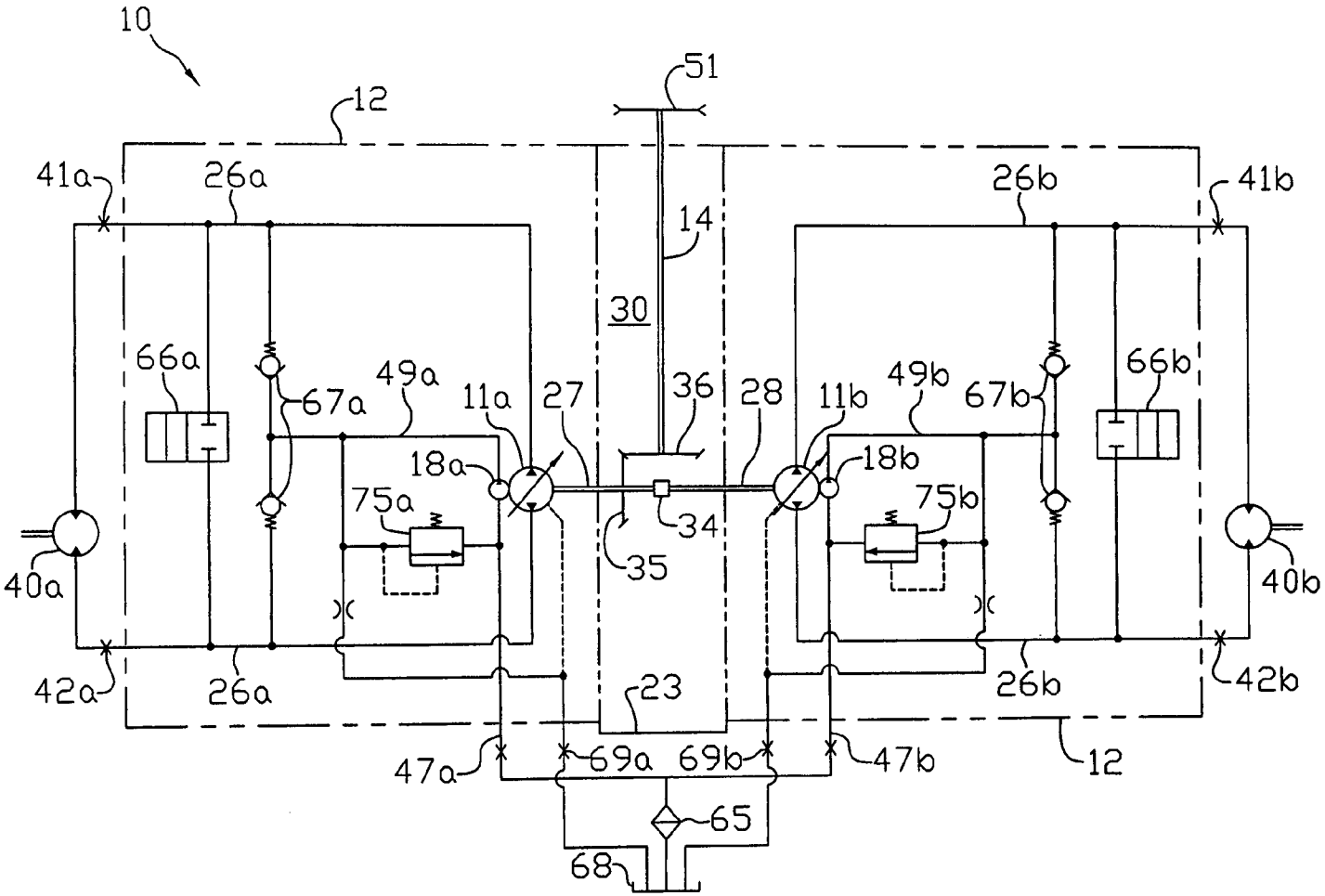
FIG. 4 is a schematic of the hydraulic circuit of the embodiment of this invention shown in FIG. 1.

A shown in FIG. 4, an external reservoir 68 is used for storing hydraulic fluid. The hydraulic fluid is pulled from reservoir 68 through filter 65 into charge inlets 47*a* and 47*b*, and hence to charge pumps 18*a* and 18*b*, respectively. Charged fluid is driven into charge gallery 49*a* and then to the porting in end cap 16*a*, and a charge relief 75*a* is provided to keep pressures within the normal operating range. Since in this embodiment pump chambers 29*a* and 29*b* are sealed from one another, a plurality of case drains 69*a* and 69*b* are provided to remove oil from pump chambers 29*a* and 29*b*, respectively. The separate case drains 69*a* and 69*b* may be located in a variety of locations, such as end caps 16*a* and 16*b*. Check valves 67*a* and 67*b* are used to maintain the proper hydraulic flow within the end caps 16*a* and 16*b*. A pair of charge pressure relief valves 75*a* and 75*b* are connected to the porting for charge pumps 18*a* and 18*b*, respectively.

Figure 5:
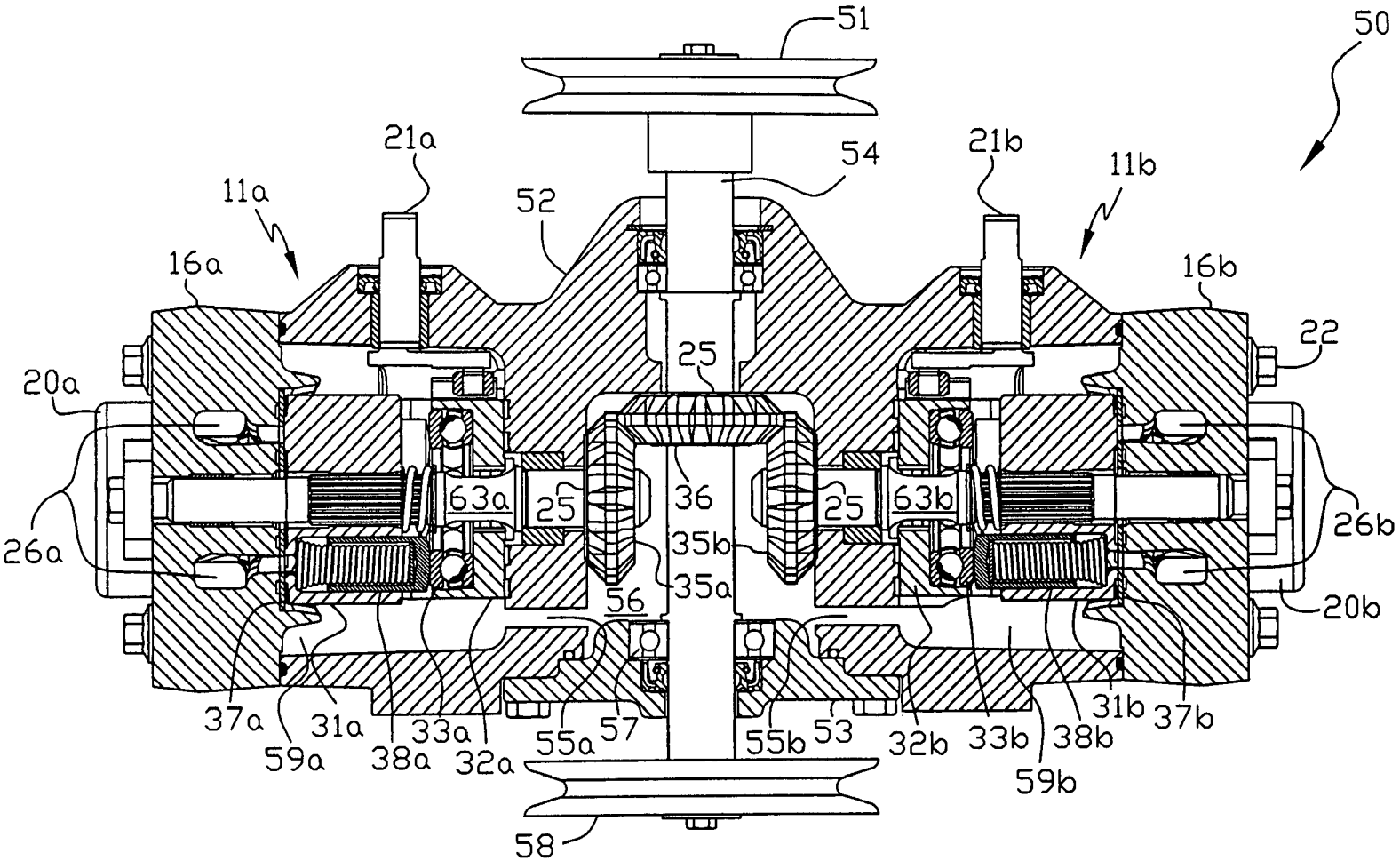
FIG. 5 is a cross-sectional side view of a second embodiment of this invention.

Input shaft 14 extends into housing 12; it can be driven by a prime mover (not shown) through a pulley, such as pulley 51 shown in FIG. 5 or some other means. Bevel gear 36 is mounted on input shaft 14 inside gear chamber 30 and is drivingly engaged to a second bevel gear 35 mounted on first pump shaft 27. Pump shaft 27 extends from gear chamber 30 into first pump chamber 29*a* and is engaged to and drivingly rotates pump cylinder block 31*a*. Bearing 44*a* provides support within housing 12. Pump shaft 27 is joined to and drives shaft 28 through coupler 34, which may be of a known design using a powdered metal part with splines to interlock the two shafts 27 and 28, or a cut steel part with a broached inner diameter to form the interlock, or a similar design. Pump shaft 28 also extends from gear chamber 30 into pump chamber 29*b* where it engages and drivingly rotates pump cylinder block 31*b* in a similar manner. As shown in, e.g., FIG. 3, input shaft 14 is generally perpendicular to pump shafts 27 and 28 and extends out the side of housing 12 as opposed to the ends thereof, which provides the user with flexibility in the application.

As shown in, e.g., FIG. 3, input shaft 27 extends through end cap 16*a* into charge housing 20*a* to drive charge pump 18*a*, which can be a gerotor style such as is shown or some other style of charge pump, such as a vane pump, geroller, gear pump or any other known design. End cap 16*a* may be secured to housing 12 by means of screws 24 or the like. The location of input shaft 14 on the side of housing 12 permits the location of charge pumps 18*a* and 18*b* on opposite ends of housing 12. Specifically, charge pump 18*a* is located within charge pump housing 20*a* mounted on end cap 16*a*. A similar charge pump 18*b* may be mounted in a similar manner in charge pump housing 20*b* on the other end of apparatus 10. It is possible that only one of the charge pumps would be required, depending on the application for which the pump apparatus 10 is to be used. Similarly, the output of one charge pump mounted on one end cap could be attached by means of internal or external hoses or integral passages to provide charge pressure to the other pump associated with the other end cap.

It will also be understood that these embodiments could include additional gear reduction. For example, in FIG. 3, a gear reduction could be used between bevel gear 36 on input shaft 14 and bevel gear 35 on pump 27. Furthermore, it will be understood that bevel gears 35 and 36 could be replaced with another means for creating a right angle turn of the rotational force, such as helical gears, a worm gear driving a spur gear and the like.

Figure 6:
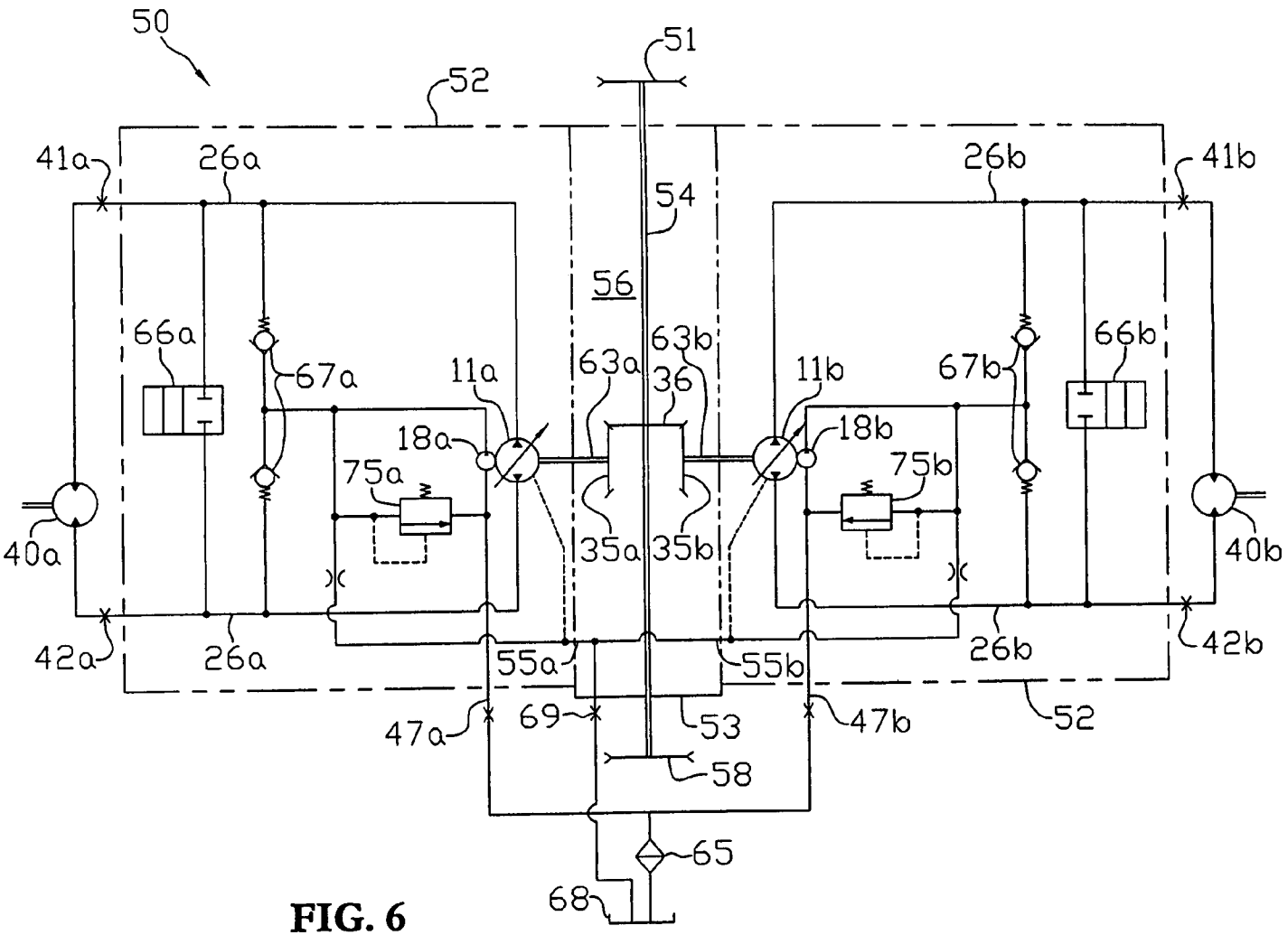
FIG. 6 is a schematic of the hydraulic circuit of the embodiment of this invention shown in FIG. 5.

FIG. 5 shows a second embodiment of this invention, where like numerals indicate identical structure with previous figures. A pump apparatus 50 has a housing 52 which creates a gear chamber 56 and a first pump chamber 59*a* and a second pump chamber 59*b*. A case fluid passage 55*a* is formed in housing 52 to connect pump chamber 59*a* and gear chamber 56, and case fluid passage 55*b* similarly connects pump chamber 59*b* with gear chamber 56, both to permit hydraulic oil to flow between the pump chambers 59*a* and 59*b* and the gear chamber 56. Since both pump chambers 59*a* and 59*b* and gear chamber 56 are hydraulically connected in this embodiment, a single case drain 69 to permit oil to flow to reservoir 68 can be formed anywhere in housing 52; if it is in the gear chamber 56, as shown in FIG. 6, it will assist in preventing contamination of pumps 11*a* and 11*b* with debris from bevel gears 36, 35*a* and 35*b* and assist in reduction of heat, as the warmer fluid from pumps 11*a* and 11*b* will be carried to the center of the housing 52. It could, however, be formed elsewhere in the circuit depending on the application requirements. The use of a single case drain also reduces machining requirements and the number of fittings required.

In this second embodiment, input shaft 54 is driven by input pulley 51 and extends through housing 52, and through cover 53, which includes bearing 57 therein to support shaft 54. Output pulley 58 may be attached to the end of shaft 54 to drive an auxiliary device such as a mower deck or other device. Cover 53 is strengthened to support bearing 57 used to rotatably support shaft 54 and the torque loads from output pulley 58.

It will be noted that using through shaft 54 as the input shaft precludes the use of a coupler to drive the two pump input shafts 63*a* and 63*b*. An alternative means of driving these shafts is shown in FIG. 5 where input shaft 54 has a first bevel gear 36 mounted thereon and drivingly engaged to a first driven bevel gear 35*a* mounted on and driving first pump shaft 63*a* and a second driven bevel gear 35*b* which is similarly mounted on and driving second pump shaft 63*b*. Such an alternative arrangement could also be used with the first embodiment in place of coupler 34. A further benefit of this design is that pump shafts 63*a* and 63*b* can be sized appropriately for the pumps; only input shaft 54 needs to be sized appropriately to handle the torque of both pumps 11*a* and 11*b* as well as the torque requirements of the auxiliary device attached to output pulley 58.

Figure 7:
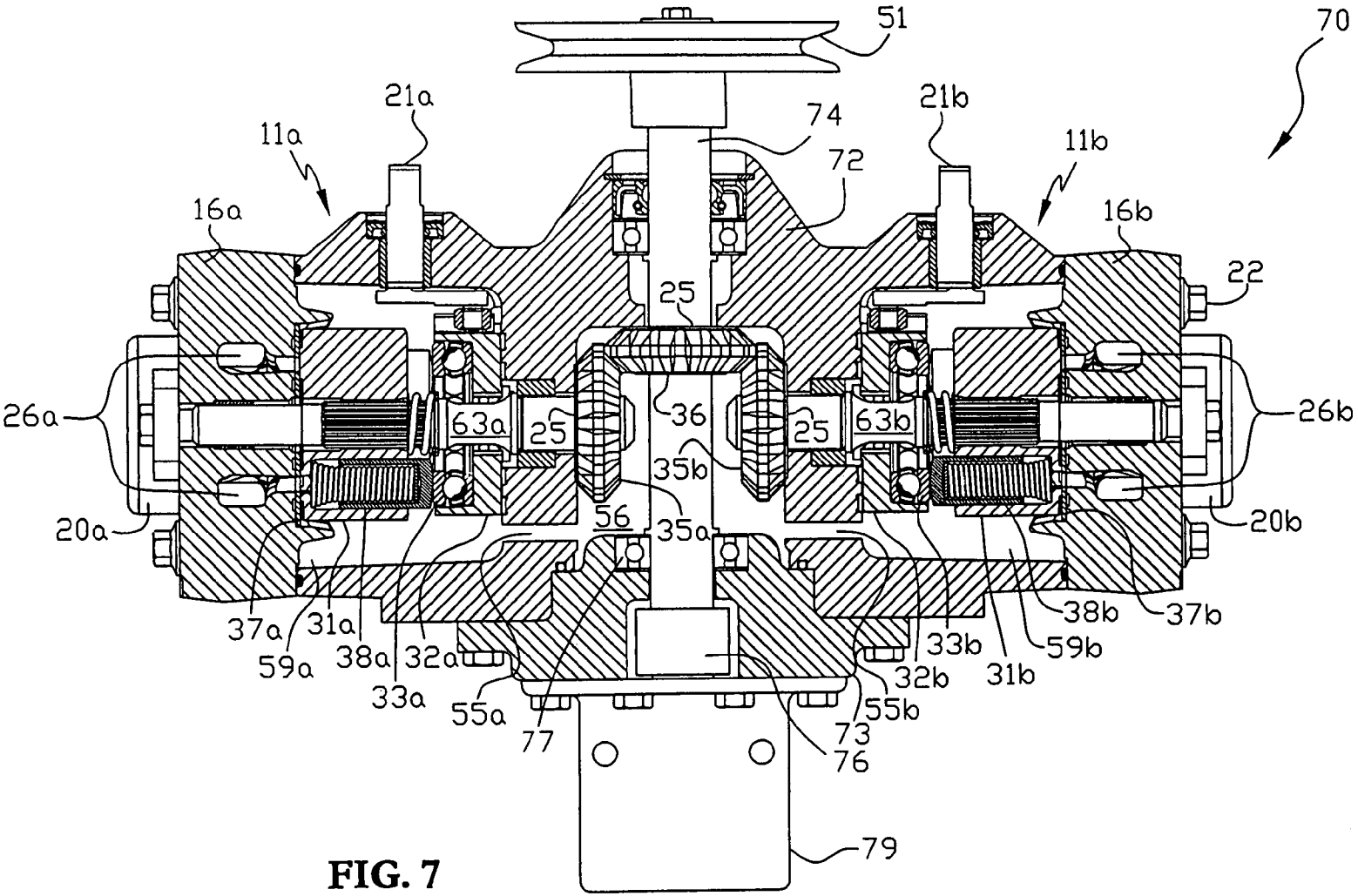
FIG. 7 is a cross-sectional side view of a third embodiment of this invention.

A third embodiment of this invention is shown in FIG. 7, which is similar in many ways to the embodiment as shown in FIG. 5. Pump apparatus 70 includes a housing 72 with cover 73 secured thereto. Input shaft 74 extends through housing 72 and cover 73, where it is supported by bearing 77, to extend out of the gear chamber 56 to drive auxiliary pump 78 through coupler 76, which also may be of the internal spline structure or other known structure. Auxiliary pump 78 could alternatively be driven directly by input shaft 74, thus eliminating the need for the coupler 76. Optional hardened washers 25 may be mounted adjacent to gears 35*a*, 35*b* and 36 to provide support for such gears running against housing 72.

Figure 8:
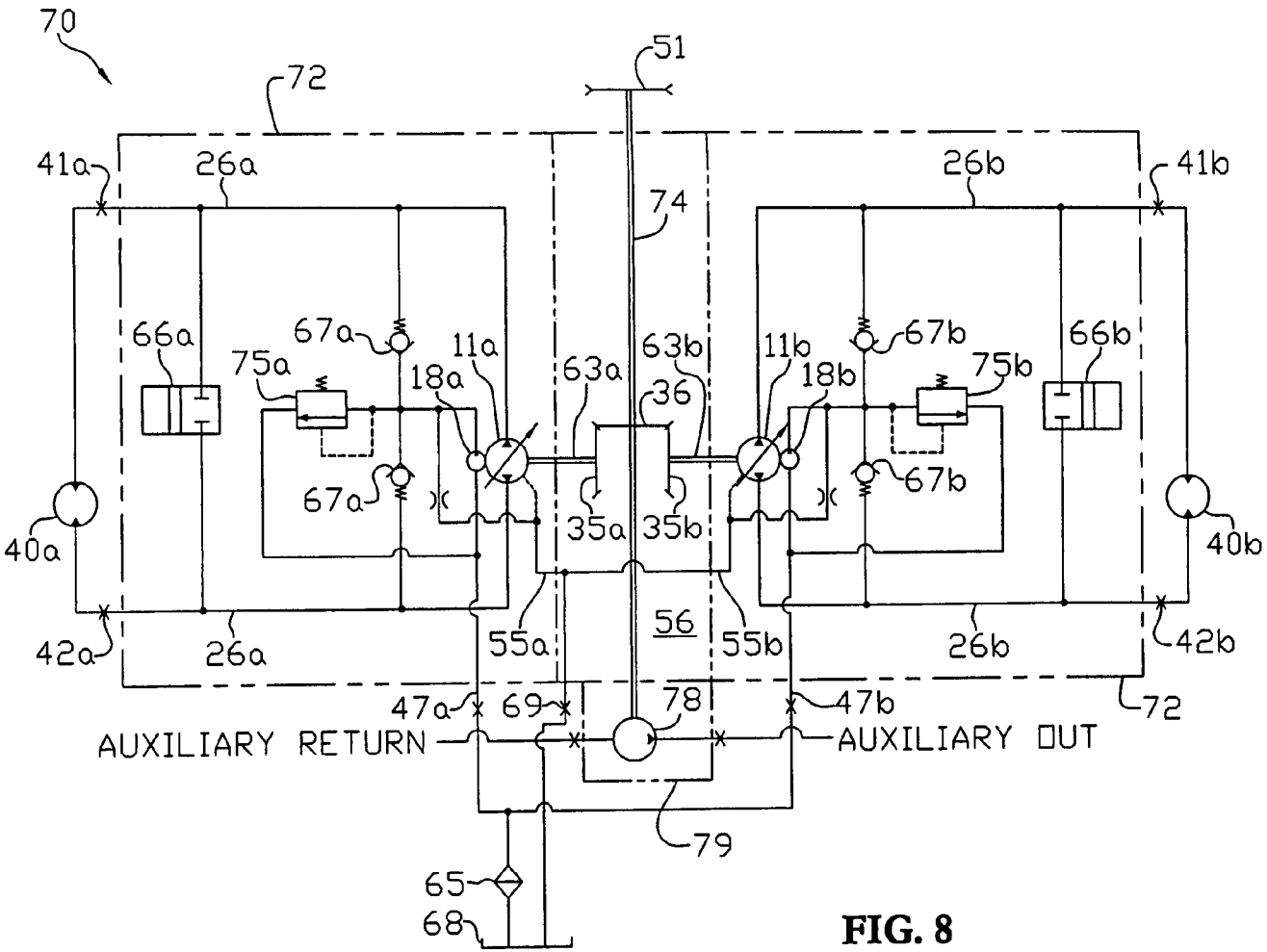
FIG. 8 is a schematic of the hydraulic circuit of the embodiment of this invention shown in FIG. 7.

Auxiliary pump 78 is mounted in auxiliary pump housing 79 mounted on cover 73, and it can be used for driving external devices such as a deck lift or the like. The auxiliary out and auxiliary return are depicted schematically in FIG. 8. As with the embodiment depicted in FIG. 6, this embodiment requires only a single case drain 69 to reservoir 68.

Figure 9:
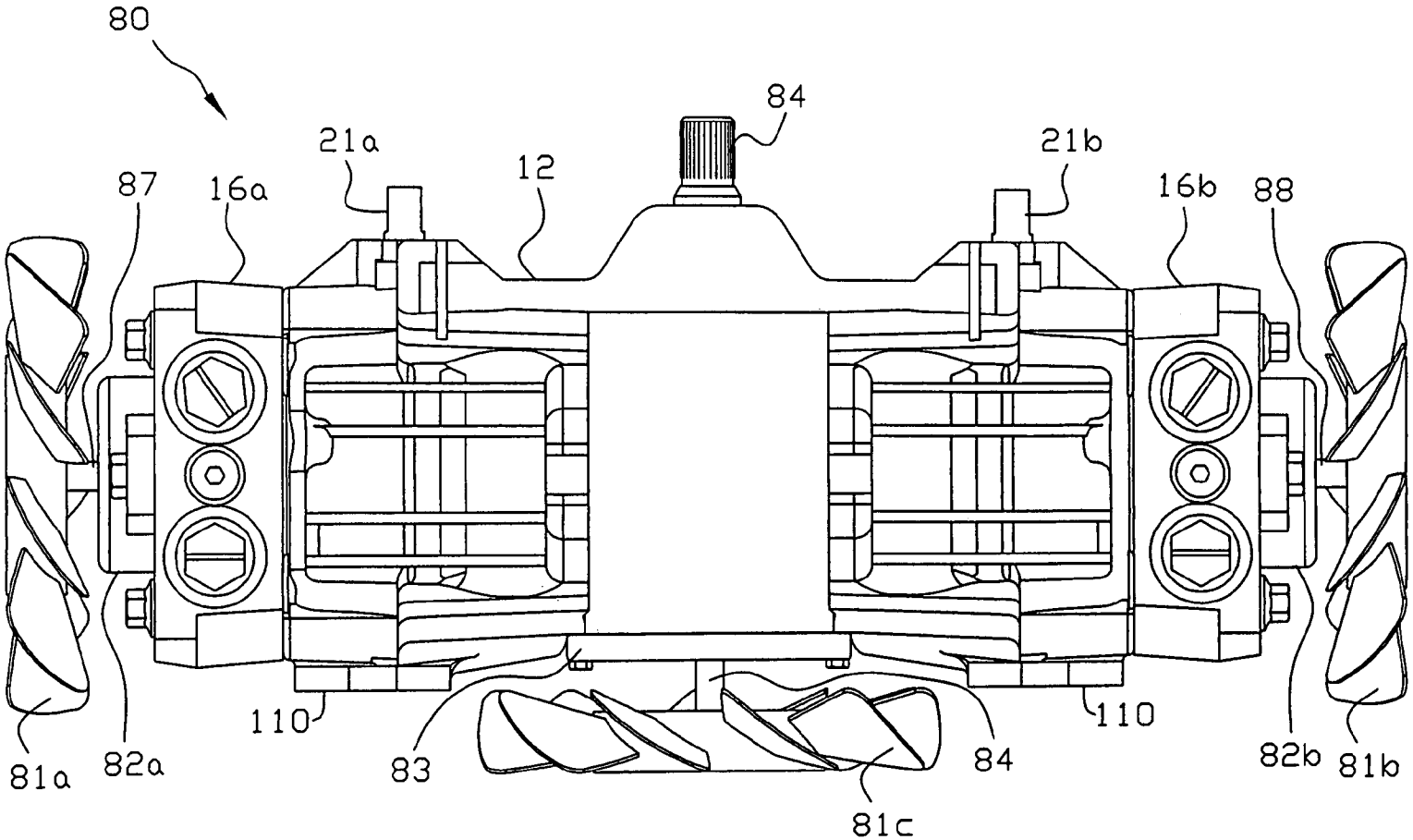
FIG. 9 is a side view of a fourth embodiment of this invention.

Yet another embodiment is depicted in FIG. 9, which is structurally substantially identical to the embodiment shown in FIG. 1. FIG. 9 shows a pump apparatus 80, where the key differences with FIG. 1 are that pump shafts 87 and 88 extend out of charge pump housings 82*a* and 82*b*, respectively, and input shaft 84 extends out of cover 83. A plurality of cooling fans 81*a* and 81*b* are mounted on pump shafts 87 and 88 respectively, while fan 81*c* may be mounted on input shaft 84. It is unlikely, though possible, that all three fans 81*a–c* would be needed for a single application.

One or more of fans 81*a–c* may be used depending on the application needs and if 81*a* and 81*b* are placed in the orientation shown in FIG. 9, so as to move air in the same direction, they may cooperate to generate a draft across housing 12 and reduce airflow turbulence. The use of such fans can in certain applications eliminate the need for an oil cooler. The most advantageous arrangement of the fans will depend on how apparatus 80 is located with respect to, e.g., a vehicle engine or the like.

A fifth embodiment of this invention is shown in FIGS. 10–13, where pump apparatus 90 has a housing 92. This embodiment is similar in many ways to the previous embodiments and in particular the embodiment shown in FIGS. 5 and 7 in terms of the arrangements of those items using identical numerals. The key difference in this embodiment is the use of a single charge pump 98 driven by input shaft 94 rather than a pair of charge pumps driven by pump shafts 93*a* and 93*b*. Charge pump 98 is mounted in a housing 99 secured to cover 95.

As will be understood, a described arrangement requires porting to be formed in both cover 95 and housing 92 to permit charge oil flow to pump cylinder blocks 31*a* and 31*b*. It would also be understood that such porting could be formed externally, e.g., through hoses and the requisite fitting connecting charge pump 98 to end caps 96*a* and 96*b*. Input shaft 94 extends through cover 95 to drive charge pump 98. The input shaft may be further supported by bearing 77. An additional bearing 97 may also be provided.

Figure 10:
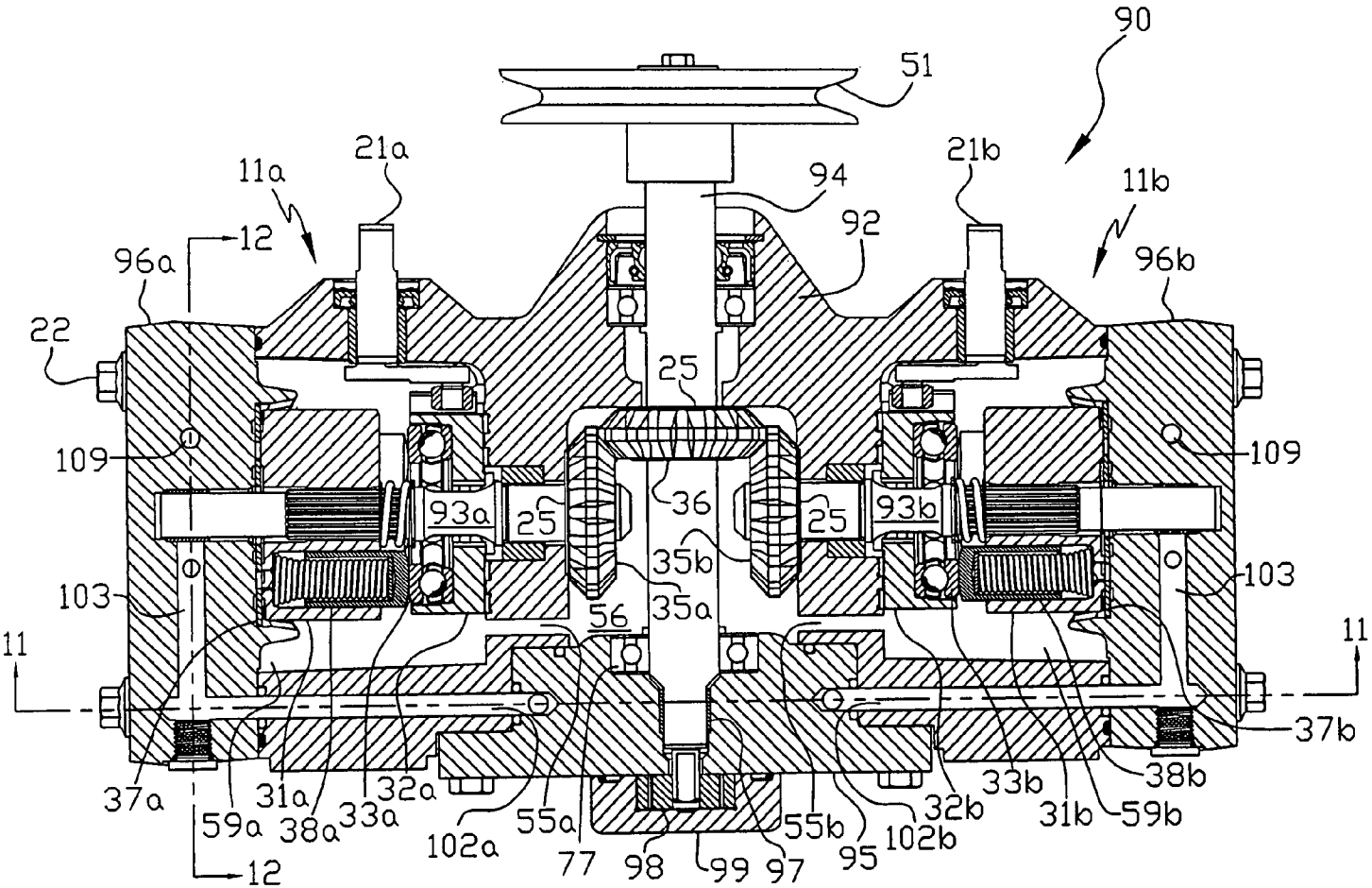
FIG. 10 is a cross-section side view of a fifth embodiment of this invention.
Figure 11:
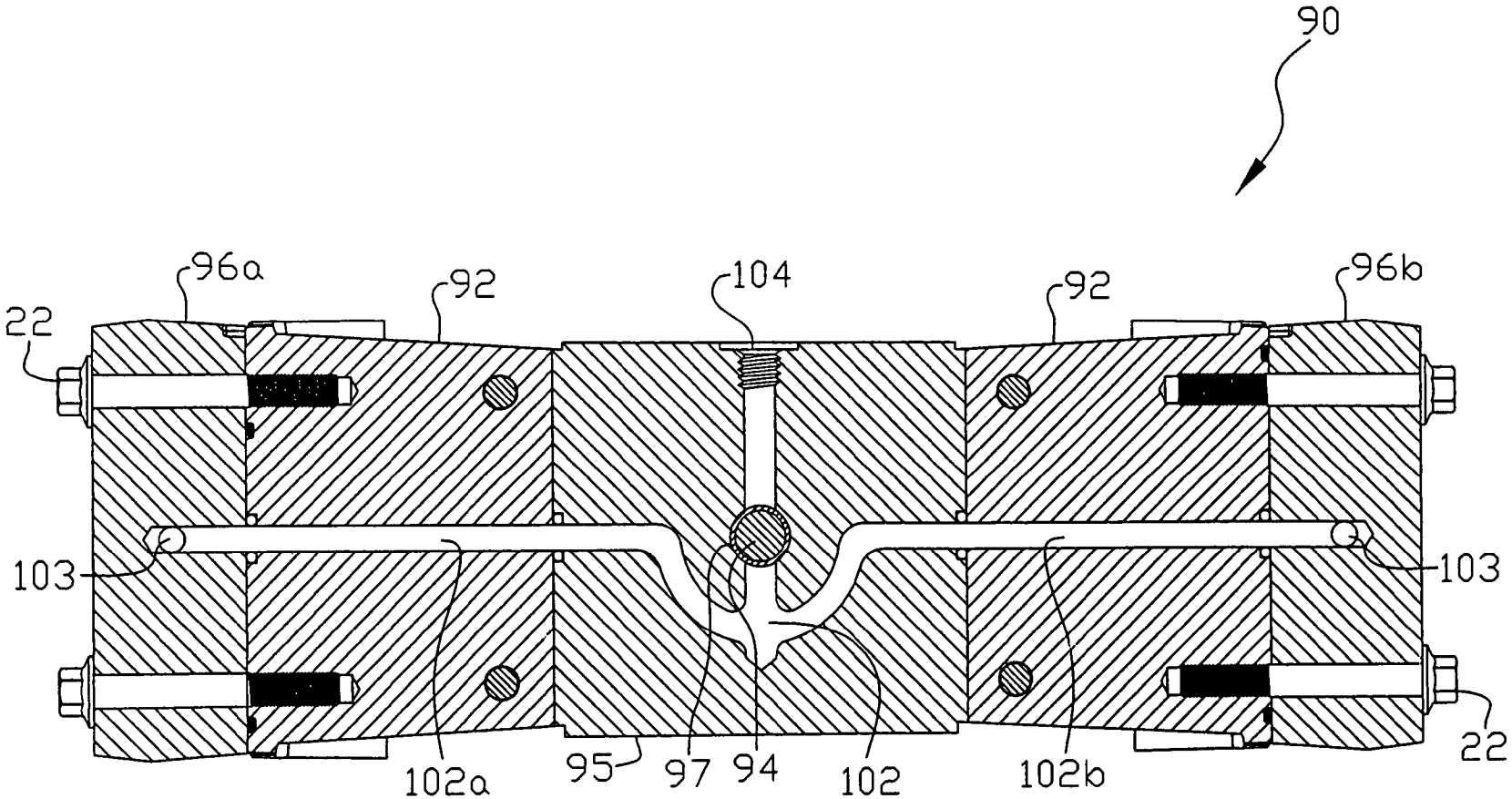
FIG. 11 is a cross-sectional view of the fifth embodiment of the pump apparatus shown along the lines 11—11 in FIG. 10.

As shown most clearly in FIGS. 10 and 11, housing 92 and cover 95 include a port 102 having a first leg 102*a* extending into the left side of housing 92 and into end cap 96*a*, and a second leg 102*b* extending opposite thereto and through the right side of housing 92 and into second end cap 96*b*. Charge inlet 104 is formed in cover 95 and connects charge pump 98 to reservoir 68, as shown in the schematic shown in FIG. 13. In the exemplary embodiment illustrated in FIGS. 10 and 11, the bearing 97 also serves to divides the charge inlet 104 from the port 102. End caps 96*a* and 96*b*, which are secured to housing 92 by screws 22 or other fastening means may be generally identical and thus only one will be described.

End cap 96*a* has a pair of system ports 105, each of which has a corresponding poppet valve 106 connecting the kidneys 107 to the system ports 105. A screw type bypass 108 can be used with a bypass port 109 connecting the two sides of the hydraulic circuit to enable the user to place the unit into bypass. The key distinction from the prior embodiments is the use of single charge port 103, which may be drilled into end cap 96*a*, and which connects to port 102*a* to provide charge fluid from charge pump 98 to the hydraulic circuit of pump 11*a*.

Figure 12:
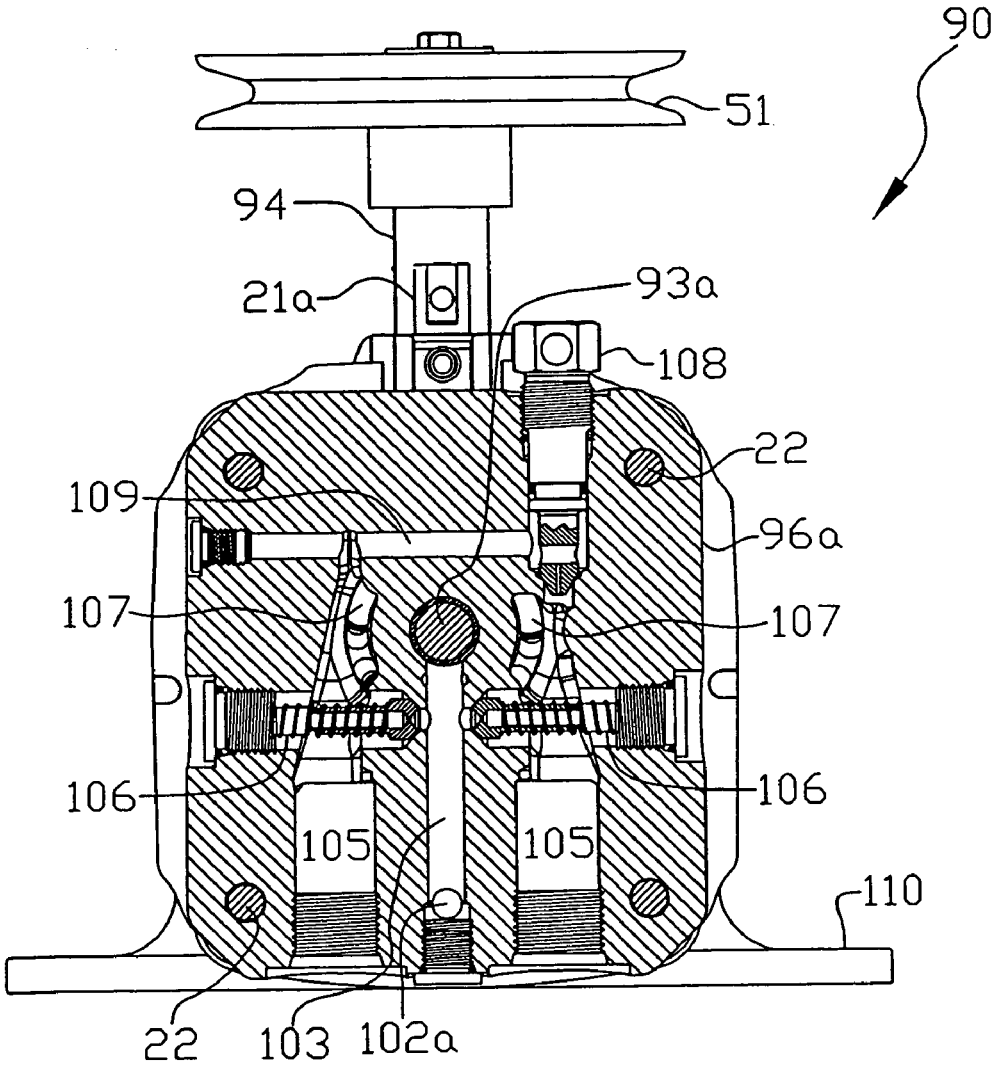
FIG. 12 is a cross-sectional view of an end cap of the fifth embodiment of this invention shown along the lines 12—12 in FIG. 10.
Figure 13:
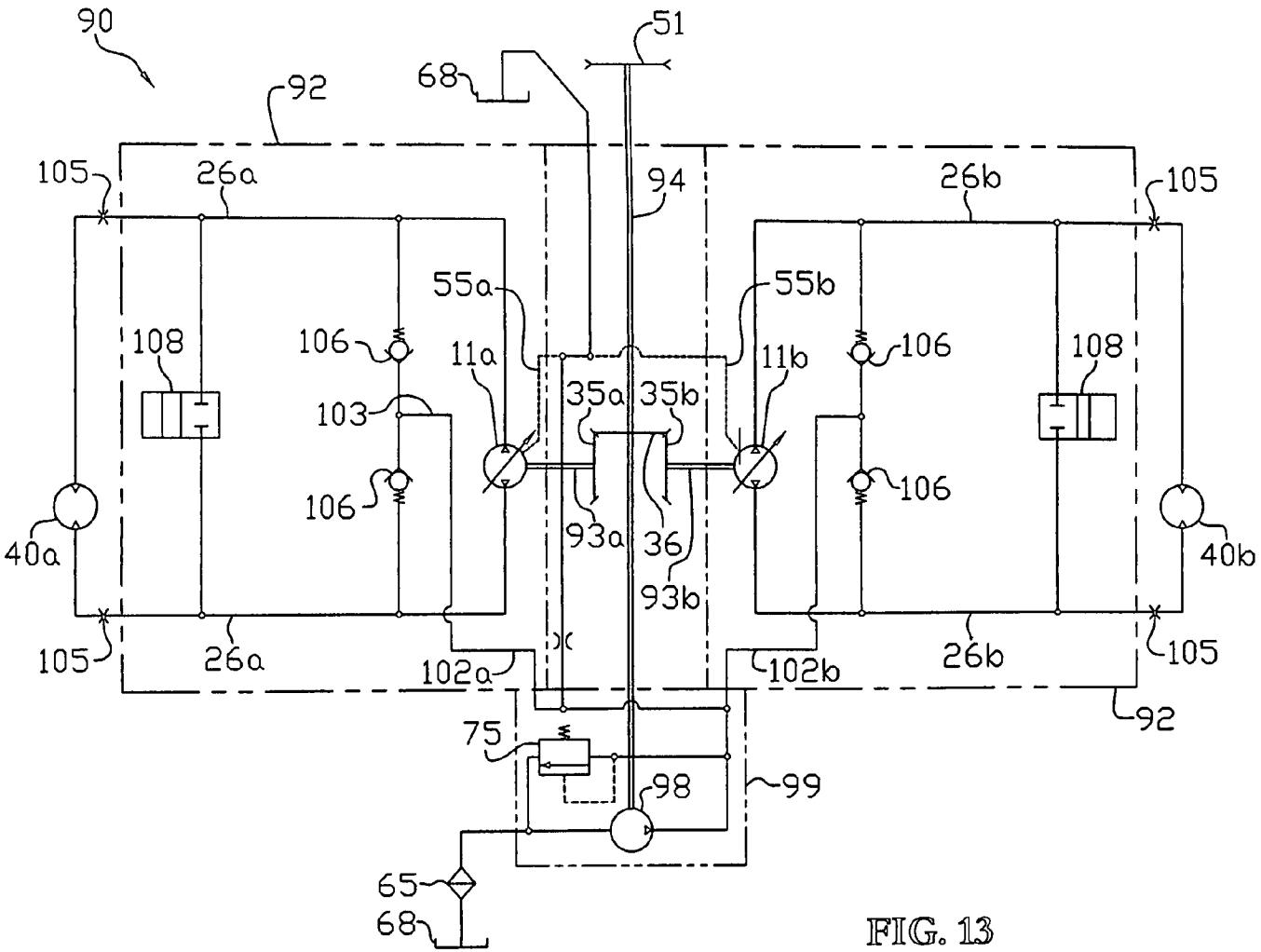
FIG. 13 is a schematic showing the embodiment of FIGS. 10–12.

As can be seen most clearly in FIG. 12, a mounting flange 110 can be formed on housing 92 to provide a means for securing the pump apparatus to a vehicle or the like.

One of the benefits of this invention is that the design affords flexibility to the user for different possible applications. For example, in FIGS. 1–3, trunnion arms 21*a* and 21*b* are shown extending out of housing 12 on the same side as and thus parallel to input shaft 14. It will be understood that trunnion arms 21*a* and 21*b* could be mounted on any side of housing 12, possibly requiring a corresponding change in the orientation of swash plates 32*a* and 32*b*, respectively, and also possibly requiring a change in the orientation of end caps 16*a* and 16*b*, respectively. Trunnion arms 21*a* and 21*b* need not be on the same side of housing 12. By way of example, if trunnion arm 21*a* is rotated 180° from the orientation shown, housing 12 would need to be modified, but the orientation of end cap 16*a* would not need to be changed. If, however, trunnion arm 21*a* was rotated 90° from the orientation shown, end cap 16*a* would also need to be similarly rotated, along with the proper housing modifications. These changes are depicted in FIGS. 15 and 16.

Figure 15:
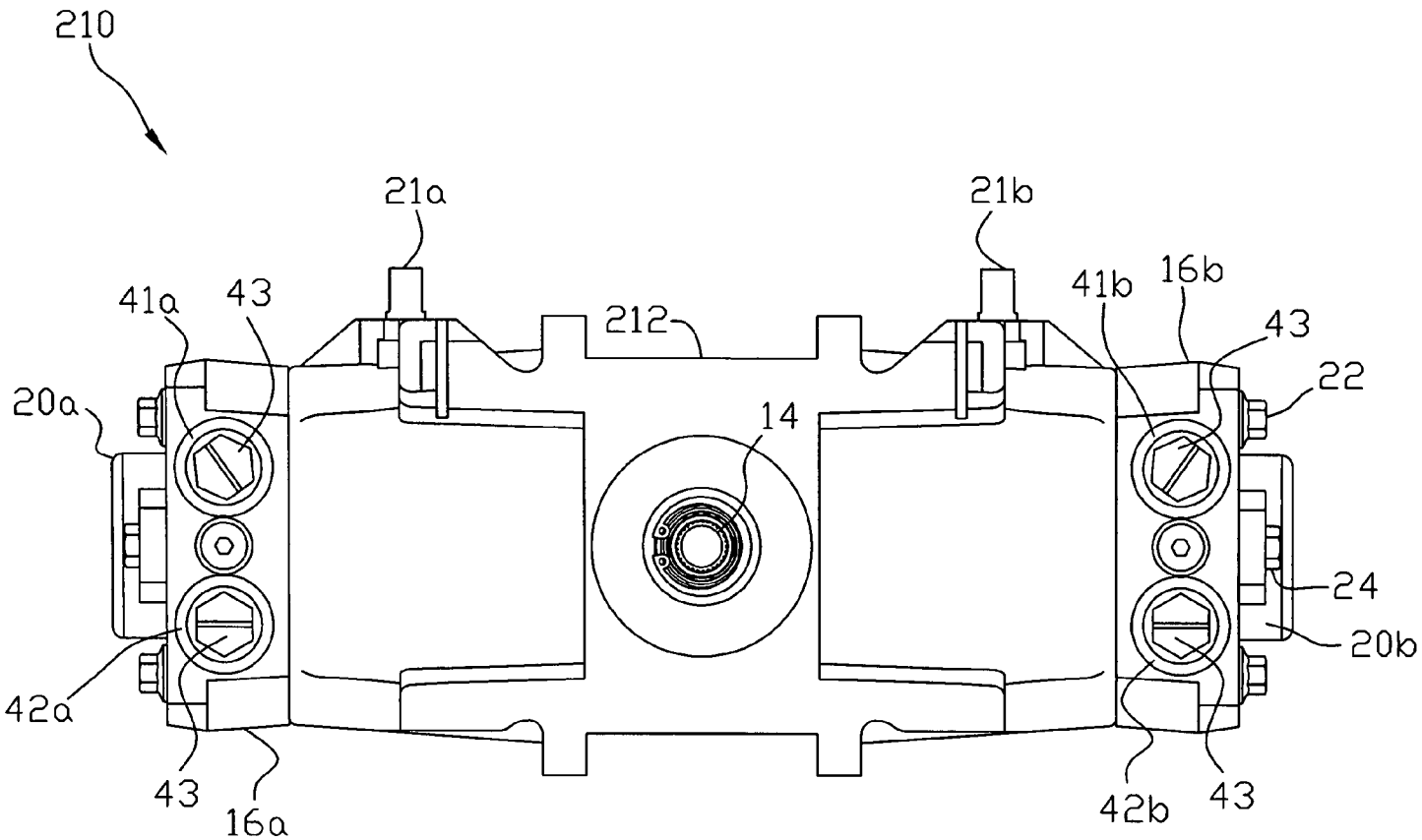
FIG. 15 is a top plan view of a further embodiment of this invention.
Figure 16:
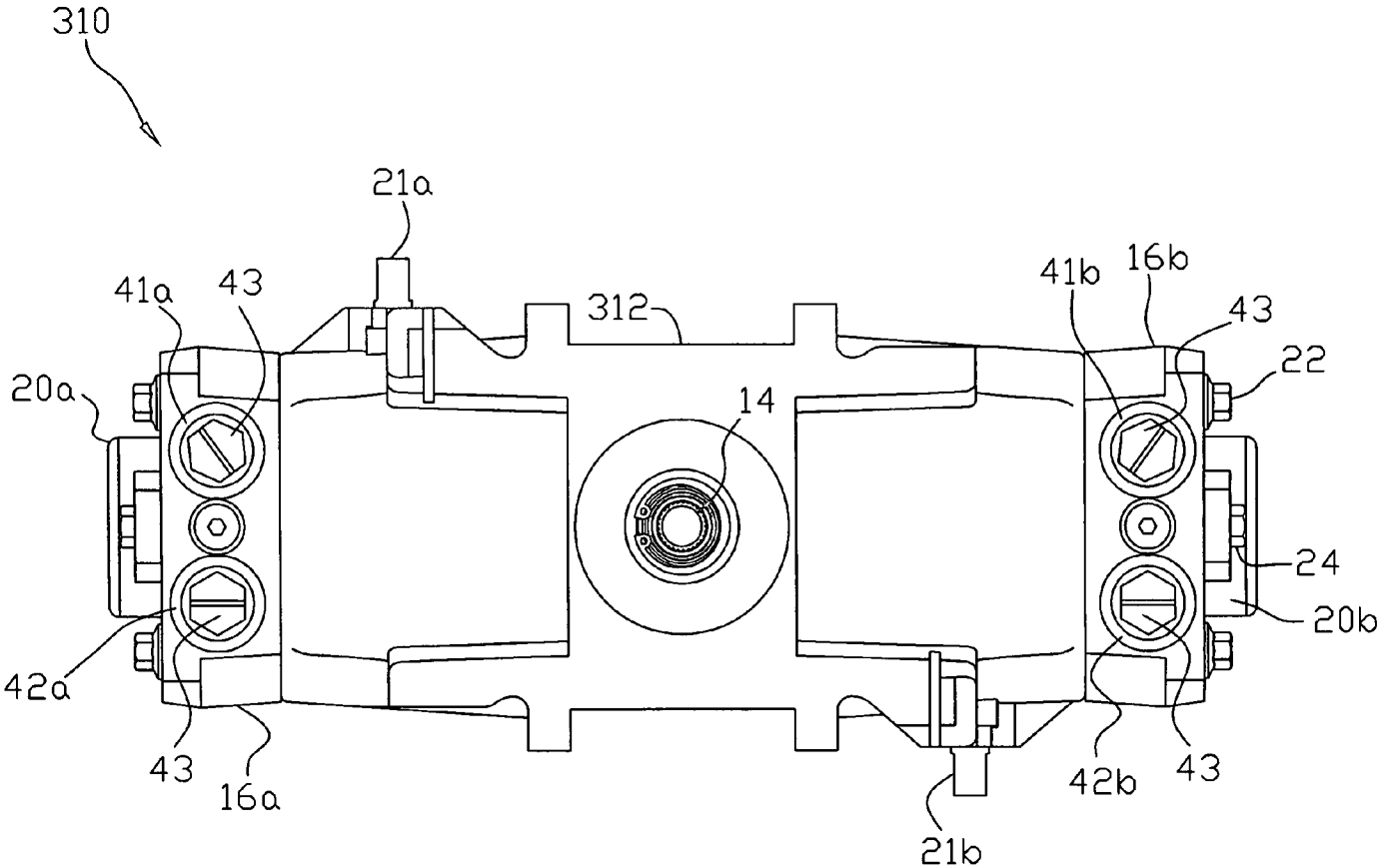
FIG. 16 is a top plan view of yet a further embodiment of this invention.

Specifically, a view of such an embodiment is shown in FIG. 15, where pump apparatus 210 includes a slightly modified housing 212, where trunnion arms 21*a* and 21*b* are mounted on the same side of housing 212, but at a 90 degree angle from input shaft 14, so that trunnion arms 21*a* and 21*b* are perpendicular to both the two pump shafts 27 and 28 and input shaft 14. FIG. 16 shows a slightly modified embodiment, pump apparatus 310, where trunnion arms 21*a* and 21*b* are mounted on opposite sides of housing 312. These changes are helpful to ensure that the unit can be installed in a wide variety of applications. For example, different vehicle applications use different linkages, and the ability to modify the pump housing in such manners affords the user maximum flexibility. It will also be understood that other types of swash plates 32*a* and 32*b*, such as a trunnion mounted swash plate, could also be used.

Another area where this invention provides increased flexibility is in the possible locations of the system ports. For example, in the embodiment depicted in FIG. 12, system ports 105 are located on the side of end cap 96 adjacent to mounting flange 110. In these embodiments, system ports 105 are parallel to the longitudinal axis of input shaft 94. This is in contrast to, e.g., the embodiments shown in FIGS. 1 and 9, where system ports 41*a*, 41*b*, 42*a* and 42*b* are formed in end caps 16*a* and 16*b*, respectively, so as to be perpendicular to input shaft 14. These different embodiments again increase the flexibility afforded to the user of this design, so that it may be used in a wide variety of vehicles or other applications.

Figure 14:
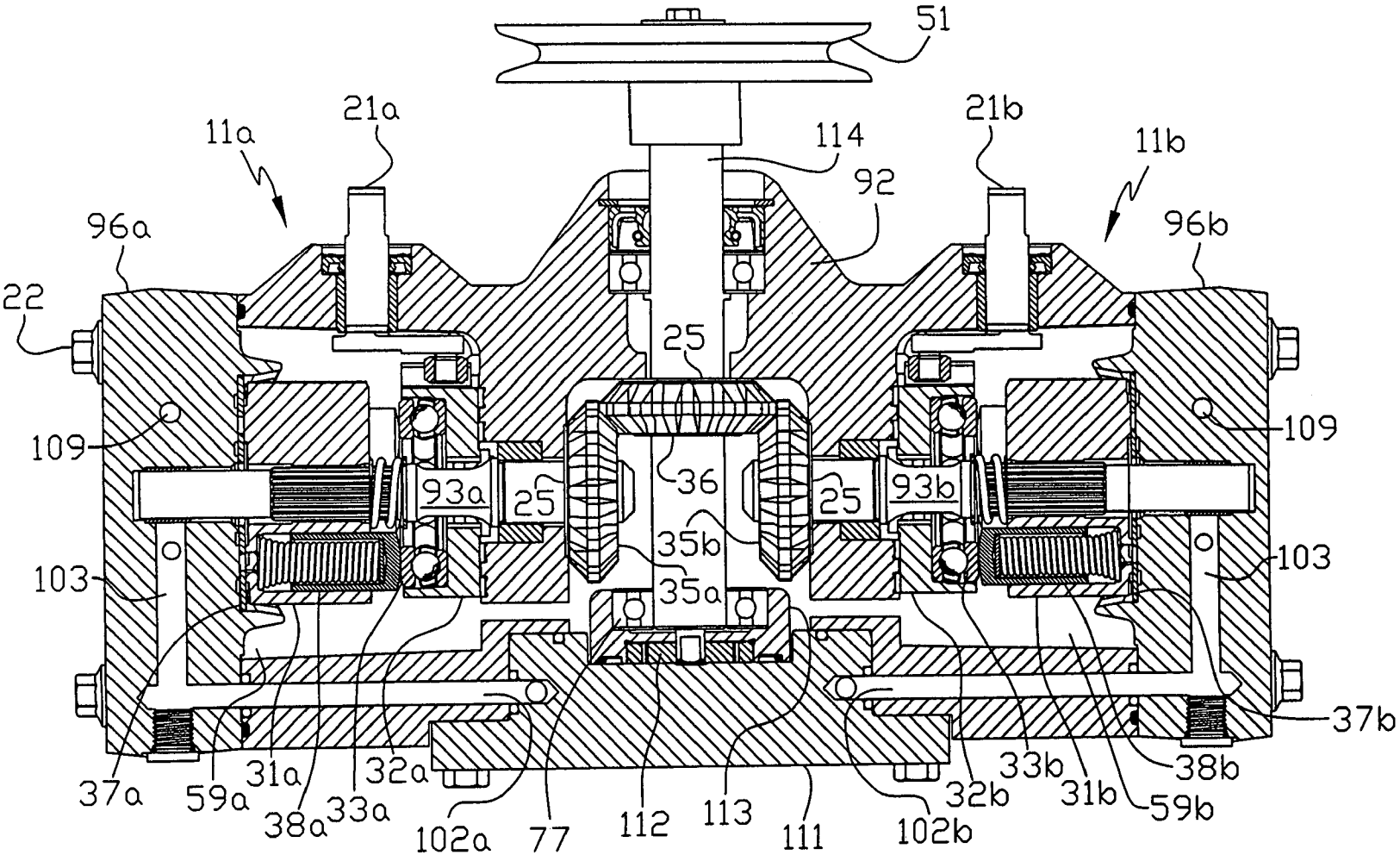
FIG. 14 is a cross-sectional side view of a sixth embodiment of the present invention.

FIG. 14 shows an alternative embodiment similar to that shown in FIG. 10, except that charge pump 112 is mounted on the inside of cover 111, and thus inside the fluid sump formed inside housing 92. Cover 113 is formed to mount not only charge pump 112 but also bearing 77 for input shaft 114. Porting similar to that shown in FIG. 11 will be formed in cover 111 to connect to ports 102*a* and 102*b*.

It is to be understood that the above description of the invention should not be used to limit the invention, as other embodiments will be obvious to one skilled in the art. This invention should be read as limited by the scope of its claims only.

What is claimed is:

1. A pump apparatus comprising:

a pump housing having a first pump chamber formed therein and having a first opening extending in a first direction, a second pump chamber formed therein and having a second opening extending in a second direction, and a gear chamber formed therein and having a third opening extending in a third direction perpendicular to the first and second directions;

a plurality of gears located in the gear chamber, wherein the third opening is larger than one of the gears;

a first pump and a first swash plate engaged thereto disposed in the first pump chamber, and a first trunnion arm engaged to the first swash plate and extending out of the pump housing;

a second pump and a second swash plate engaged thereto disposed in the second pump chamber, and a second trunnion arm engaged to the second swash plate and extending out of the pump housing;

a first pump shaft drivingly engaged to the first pump and a second pump shaft drivingly engaged to the second pump; and an input shaft disposed in the pump housing and drivingly engaged to both the first and second pump shafts, where at least one end of the input shaft extends out of the pump housing and the longitudinal axis of the input shaft is perpendicular to the longitudinal axes of the first and second pump shafts, wherein the first and second trunnion arms are mounted parallel to one another and perpendicular to the longitudinal axis of the input shaft.

2. A pump apparatus as set forth in claim 1, wherein the longitudinal axes of the first and second pump shafts are collinear.

3. A pump apparatus as set forth in claim 1, wherein the first and second trunnion arms both extend out of the same side of the pump housing.

4. A pump apparatus as set forth in claim 1, wherein the first trunnion arm extends out of a first side of the pump housing and the second trunnion arm extends out of a second side opposite to the first side of the pump housing.

5. A pump apparatus as set forth in claim 1, wherein both ends of the input shaft extend out of the pump housing.

6. A pump apparatus as set forth in claim 1, further comprising a first end cap mounted to the pump housing adjacent to the first pump chamber and having a first set of system ports formed therein, and a second end cap mounted to the pump housing adjacent the second pump chamber and having a second set of system ports formed therein, where the first and second sets of system ports extend into their respective end cap in a direction parallel to the longitudinal axis of the input shaft.

7. A pump apparatus comprising:

a pump housing having first and second pump chambers formed therein;

a first end cap mounted to the pump housing adjacent to the first pump chamber and a second end cap mounted to the pump housing adjacent the second pump chamber, both end caps comprising a first surface mounted to the pump housing, a second surface formed generally parallel to the first surface, and a plurality of sides connecting the first and second surfaces;

a first pump rotatably disposed on the first end cap and a second pump rotatably disposed on the second end cap;

a first pump shaft drivingly engaged to the first pump and a second pump shaft drivingly engaged to the second pump;

an input shaft disposed in the pump housing and drivingly engaged to both the first and second pump shaft, where at least one end of the input shaft extends out of the pump housing and the longitudinal axis of the input shaft is perpendicular to the longitudinal axes of the first and second pump shafts;

a first charge pump mounted on the second surface of the first end cap; and a first set of system ports formed in the first end cap, where the first set of system ports extend into one of the sides of the first end cap in a direction parallel to the longitudinal axis of the input shaft.

8. A pump apparatus as set forth in claim 7, further comprising a second set of system ports formed in the second end cap, where the second set of system ports extend into one of the sides of the second end cap in a direction parallel to the longitudinal axis of the input shaft.

9. A pump apparatus as set forth in claim 7, further comprising a mounting flange formed on the pump housing adjacent to the first set of system ports.

10. A pump apparatus as set forth in claim 8, wherein the longitudinal axes of the first and second pump shafts are collinear.

11. A pump apparatus as set forth in claim 8, wherein both ends of the input shaft extend out of the pump housing.

12. A pump apparatus comprising:

a pump housing having a first pump chamber formed therein and having a first opening extending in a first direction, a second pump chamber formed therein and having a second opening extending in a second direction, and a gear chamber formed therein and having a third opening extending in a third direction perpendicular to the first and second directions;

a plurality of gears located in the gear chamber, wherein the third opening is larger than one of the gears;

a first end cap mounted to the pump housing adjacent to the first pump chamber and a second end cap mounted to the pump housing adjacent to the second pump chamber;

a first pump rotatably disposed on the first end cap and a second pump rotatably disposed on the second end cap;

a first pump shaft drivingly engaged to the first pump and a second pump shaft drivingly engaged to the second pump;

an input shaft disposed in the pump housing and drivingly engaged to both the first and second pump shafts, where at least one end of the input shaft extends out of the pump housing and the longitudinal axis of the input shaft is perpendicular to the longitudinal axes of the first and second pump shafts; and a first set of system ports formed in the first end cap, where the first set of system ports extend into the first end cap in a direction perpendicular to the longitudinal axis of the input shaft.

13. A pump apparatus as set forth in claim 12, further comprising a second set of system ports formed in the second end cap, where the second set of system ports extend into the second end cap in a direction perpendicular to the longitudinal axis of the input shaft.

14. A pump apparatus as set forth in claim 13, wherein the longitudinal axes of the first and second pump shafts are collinear.

15. A pump apparatus as set forth in claim 13, wherein both ends of the input shaft extend out of the pump housing.

16. A pump apparatus as set forth in claim 12, wherein the pump housing further comprises a first wall located between the first pump chamber and the gear chamber, and a second wall located between the second chamber pump and the chamber.

* * * * *